US008652074B2

(12) United States Patent
Doi

(10) Patent No.: US 8,652,074 B2
(45) Date of Patent: Feb. 18, 2014

(54) WALKING ASSIST DEVICE

(75) Inventor: Masahiro Doi, Toyota (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 322 days.

(21) Appl. No.: 13/242,128

(22) Filed: Sep. 23, 2011

(65) Prior Publication Data

US 2012/0016276 A1 Jan. 19, 2012

Related U.S. Application Data

(63) Continuation of application No. PCT/JP2010/055227, filed on Mar. 25, 2010.

(51) Int. Cl.

| | |
|---|---|
| ***A61H 1/00*** | (2006.01) |
| ***A61H 1/02*** | (2006.01) |
| ***A61H 5/00*** | (2006.01) |

(52) U.S. Cl.
USPC ..... 601/34; 601/5

(58) Field of Classification Search
USPC ..... 601/5, 33–36; 340/573.1
See application file for complete search history.

(56) References Cited

U.S. PATENT DOCUMENTS

| | | | | |
|---|---|---|---|---|
| 4,697,808 | A * | 10/1987 | Larson et al. | 482/51 |
| 5,112,296 | A * | 5/1992 | Beard et al. | 602/28 |
| 7,549,969 | B2 * | 6/2009 | van den Bogert | 602/16 |
| 2006/0195223 | A1 * | 8/2006 | Kawai et al. | 700/245 |
| 2008/0139968 | A1 | 6/2008 | Endo et al. | |
| 2008/0161937 | A1 | 7/2008 | Sankai | |
| 2008/0249438 | A1 * | 10/2008 | Agrawal et al. | 601/35 |
| 2010/0256537 | A1 * | 10/2010 | Menga | 601/34 |
| 2011/0004322 | A1 | 1/2011 | Sankai | |
| 2013/0238183 | A1 * | 9/2013 | Goulding | 701/26 |

FOREIGN PATENT DOCUMENTS

| | | | |
|---|---|---|---|
| JP | 63-163172 | A | 7/1988 |
| JP | 3-23313 | U | 3/1991 |
| JP | 4-372821 | A | 12/1992 |
| JP | 7-50122 | B2 | 5/1995 |
| JP | 10-170262 | A | 6/1998 |
| JP | 2004-329520 | A | 11/2004 |
| JP | 2006-167223 | A | 6/2006 |
| JP | 2006-204426 | A | 8/2006 |

(Continued)

OTHER PUBLICATIONS

International Search Report of PCT/JP2010/055227 mailed May 11, 2010 & Written Opinion.

(Continued)

*Primary Examiner* — Kristen Matter
(74) *Attorney, Agent, or Firm* — Kenyon & Kenyon LLP

(57) ABSTRACT

A walking assist device which assists the knee joint with well synchronizing with the upper leg motion during the swing phase at low cost may be provided. The walking assist device comprises an upper link, a lower link, a rotary joint, an actuator, and a controller. The upper link is to be attached to an upper leg of a user. The lower link is to be attached to the lower leg of the user. The rotary joint swingably connects the lower link to the upper link. The rotary joint is coaxially aligned with the user's knee joint when the user wears the walking assist device. The actuator swings the lower link relative to the upper link. The controller controls the actuator so that the lower link guides the user's walking motion.

2 Claims, 5 Drawing Sheets

(56) References Cited

FOREIGN PATENT DOCUMENTS

| | | | |
|---|---|---|---|
| JP | 2007-130172 | A | 5/2007 |
| JP | 2007-275482 | A | 10/2007 |
| JP | 2008-068046 | A | 3/2008 |
| JP | 2008-278921 | A | 11/2008 |
| JP | 2009-039454 | A | 2/2009 |
| JP | 2009-207840 | A | 4/2009 |
| JP | 2009-213538 | A | 9/2009 |
| JP | 2010-035899 | A | 2/2010 |

OTHER PUBLICATIONS

International Preliminary Report on Patentability of PCT/JP2010/055227 mailed Jan. 27, 2011.

* cited by examiner

WALKING ASSIST DEVICE

CROSS-REFERENCE TO RELATED APPLICATION

This application is a Continuation of International Application No. PCT/JP2010/055227 filed on Mar. 25, 2010, the disclosure of which is hereby incorporated by reference herein in its entirety.

TECHNICAL FIELD

The present invention relates to a walking assist device that assists user's walking motion by applying torque to the user's knee joint.

BACKGROUND ART

A walking assist device which assists walking motion of a user by applying torque to the user's knee joint has been developed. Japan Patent Application Publication No. 2009-207840 discloses one example of such a walking assist device. The typical walking assist device may have a multi-link mechanical structure that is to be attached along the user's leg. One link of the multi-link structure is to be attached to the user's upper leg. Other one link is to be attached to the user's lower leg. The upper link and the lower link are connected by the rotary joint. When the user wears the walking assist device, the rotary joint is coaxially aligned with the knee joint. According to such configuration, the lower link is able to swing while keeping parallel to user's lower leg. This walking assist device is also provided with an actuator that swings the lower link. By the output power of the actuator, the plurality of links emulates the ideal walking motion of the leg and thus, the walking assist device guides the user's leg motion. The multi-link type walking assist device provided with the actuator may be commonly called a "robot suit".

The motion of the leg during walk is basically defined by the swing of the upper leg around the hip joint pitch axis and the swing of the lower log around the knee joint pitch axis. In other words, the leg motion during walk is defined by the time-dependent changes of the hip joint angle (around the pitch axis) and the knee joint angle (around the pitch axis). The walking assist device stores the target rotation angle time series data (the target trajectory) that simulates the time-dependent changes of the hip joint angle and the knee joint angle during walk, and the device drives the rotary joints corresponding to the knee and hip joints of the user so that each follows its target trajectory. It is noted that the walking assist device may store the predetermined target trajectories, or the device may generate, in real time, the target trajectories in response to the characteristics of the user's walking motion such as walking speed and/or stride length. Also, it is noted that "the joint angle" of the user's joint and "the joint angle" of the rotary joint of the walking assist device are not distinguished hereinafter for simplification of the explanation. Thus, the target angle (target trajectory) of the rotary joint corresponding to the hip joint may be referred to as the target angle (target trajectory) of the hip joint, and the target angle (target trajectory) of the rotary joint corresponding to the knee joint may be referred to as the target angle (target trajectory) of the knee joint, or referred to as the target knee joint angle. Furthermore, the hip joint angle corresponds to the swing angle of the upper leg, and the knee joint angle corresponds to the swing angle of the lower leg. Thus, the target knee joint angle may be referred to as the target swing angle of the lower link.

SUMMARY OF INVENTION

The upper leg and the lower leg swing together in synchrony. The walking assist device having the additional actuator and the additional rotary joint that corresponds to the user's hip joint in addition to the actuator and the rotary joint corresponding to the user's knee joint may guide the whole leg to swing. Such a walking assist device can easily synchronize the swings of the upper leg and the lower leg because such a walking assist device has the target trajectories for both of the hip joint angle and the knee joint angle.

On the other hand, for a user who is not able to appropriately control the knee joint but can control his/her hip joint, it is preferable that the walking assist device applies torque to the knee joint without applying torque to the hip joint motion or without restricting the hip joint. Such a walking assist device may have the target trajectory only for the knee joint and may not control the motion of the user's hip joint. Thus, such a walking assist device may be difficult to synchronize the swings of the lower leg to the upper leg during the swing phase.

For the walking assist device that applies torque to the knee joint but does not apply torque to the hip joint, one way to assist the knee joint in synchrony with the swing of the upper leg is to determine the target angle for the knee joint according to the inclination angle (or the swing angle) of the upper leg around the pitch axis. However, the inclination angle sensor may be expensive. Besides, in the case of determining the target knee joint angle according to the inclination angle of the upper leg, the relation between the inclination angle of the upper leg and the target knee joint angle is static. Therefore, the way of determining the target knee joint angle according to the inclination angle of the upper leg may not be appropriate in the case where the swing of the upper leg dynamically changes. The present invention provides a low-cost walking assist device which assists the knee joint with well synchronization with the upper leg motion during the swing phase.

It is known that the behavior of the swings of the upper and lower legs in the swing phase is similar to the swing of the double pendulum. It is because the walking motion may be realized so as to minimize the energy for swinging the leg. (The free motion of the double pendulum is realized with the minimum energy.) The teachings disclosed by the present application are derived using this knowledge. The walking assist device according to the present invention is provided with a pendulum at the lower end of the upper link. The pendulum physically emulates the motion of the lower leg which cooperatively swings with the upper leg. The device controls the lower link in response to the motion of the pendulum.

One teaching according to the present disclosure provides the following walking assist device. The walking assist device comprises an upper link, a lower link, a rotary joint, an actuator, and a controller. The upper link is to be attached to the user's upper leg. The lower link is to be attached to the user's lower leg. The rotary joint swingably connects the lower link to the upper link. When the user wears the walking assist device, the rotary joint coaxially aligns with the knee joint of the user. The actuator swings the lower link with respect to the upper link. The controller controls the actuator so that the lower link guides the user's walking motion.

The walking assist device is also provided with a pendulum and a pendulum sensor. The pendulum is provided at the rotation axis of the rotary joint (at the pivot of the lower link). The pendulum swings around the pivot. The swing of the pendulum is induced by the swing motion of the user's upper leg during the swing phase. The pendulum sensor detects the swing angle of the pendulum. The controller controls the swing of the lower link based on the swing angle of the pendulum.

DETAILED DESCRIPTION OF INVENTION

Figure 1:
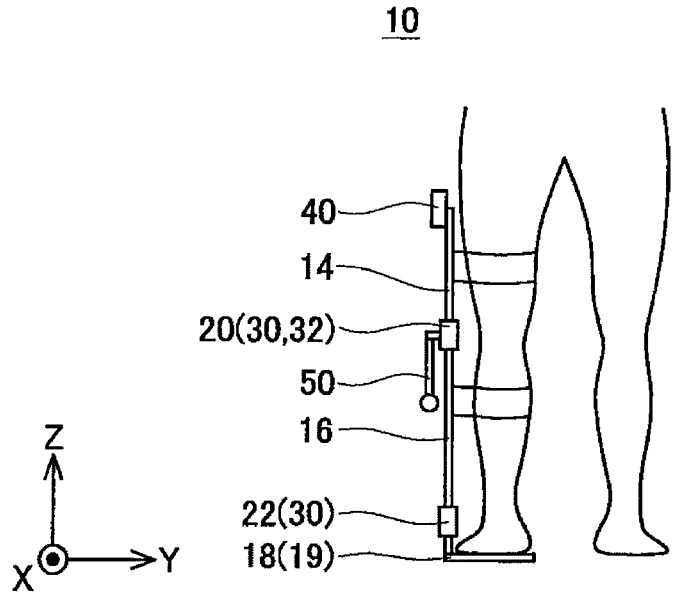
FIG. 1 shows a schematic front view of a walking assist device.
Figure 2:
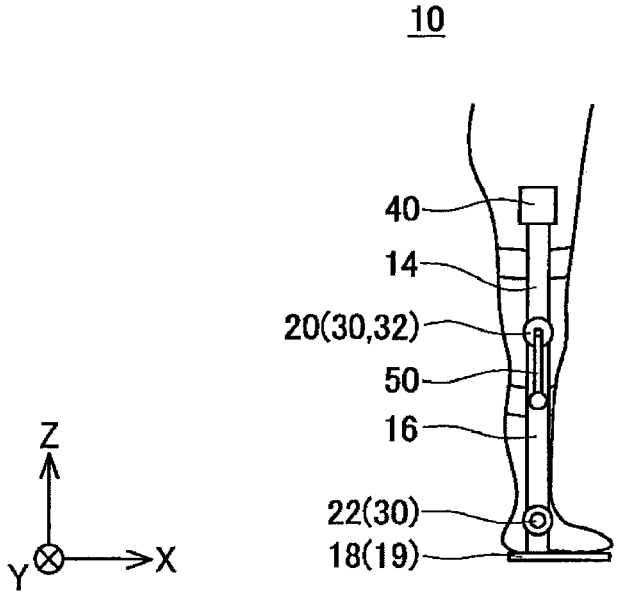
FIG. 2 shows a schematic side view of the walking assist device.

FIG. 1 shows a schematic front view of a walking assist device 10. FIG. 2 shows a schematic side view of the walking assist device 10. The walking assist device 10 is to be attached to one of the user's legs. In this embodiment, the walking assist device 10 is attached to the right leg of the user as shown in FIG. 1 and FIG. 2. The walking assist device 10 applies torque to the right knee joint of the user in response to the user's walking motion so that the right lower leg swings smoothly.

The coordinates denoted in FIG. 1 and FIG. 2 will be explained. The X axis extends in the front-back direction of the user. The Y axis extends in the right-left direction of the user. The Z axis extends in the up-down direction of the user. In the technical field of the robotics, generally, the axis (X axis) extending in the front-back direction of the user is referred to as "the roll axis", the axis (Y axis) extending in the right-left direction is referred to as "the pitch axis", and the axis (Z axis) extending in the up-down direction is referred to as "the yaw axis".

The structure of the walking assist device 10 will be explained. The walking assist device 10 comprises an upper leg link 14 (an upper link 14) to be attached to the user's upper leg, a lower leg link 16 (a lower link 16) to be attached to the user's lower leg, and a foot link 18 to be attached to the user's foot. The upper link 14 and the lower link 16 are connected by a first rotary joint 20. The lower link 16 and the foot link 18 are connected by a second rotary joint 22. When the user wears the walking assist device 10, the first joint 20 coaxially aligns with the knee joint and the second rotary joint 22 is coaxially aligns with the pitch axis of the ankle joint. The first rotary joint 20 is provided with a motor 32. The motor 32 is controlled by the controller 40. The motor 32 swings the lower link 16 relative to the upper link 14. The controller 40 is attached to the upper link 14.

The walking assist device 10 is also provided with a pressure sensor 19 and angle sensors 30. The pressure sensor 19 is disposed at the sole of the foot link 18. The pressure sensor 19 measures pressure that the foot link 18 receives from the ground. If the measured pressure is greater than a predetermined threshold, it means that the foot is grounding. On the other hand, if the measured pressure is smaller than the predetermined threshold, it means that the foot does not grounding, i.e. it means that the leg is in the swing phase. The controller 40 uses the pressure sensor 19 for determining whether the leg that wears the walking assist device 10 is being grounding or floating. In other words, the pressure sensor 19 corresponds to one example of the ground sensor.

The angle sensors 30 are provided to the first rotary joint 20 and the second rotary joint 22. The angle sensors 30 measure the rotation angles of the rotary joints (the swing angles of the links). The angle sensors 30 may typically be implemented by the encoders. It is noted that the swing angle of the lower link 16 corresponds to the knee joint angle of the user. Further, the swing angle of the foot link 18 corresponds to the angle of the ankle joint.

A spring (not shown) may be provided between the lower link 16 and the foot link 18. The spring force is exerted on the foot link 18 so as to return the foot link 18 at the neutral position.

Figure 3:
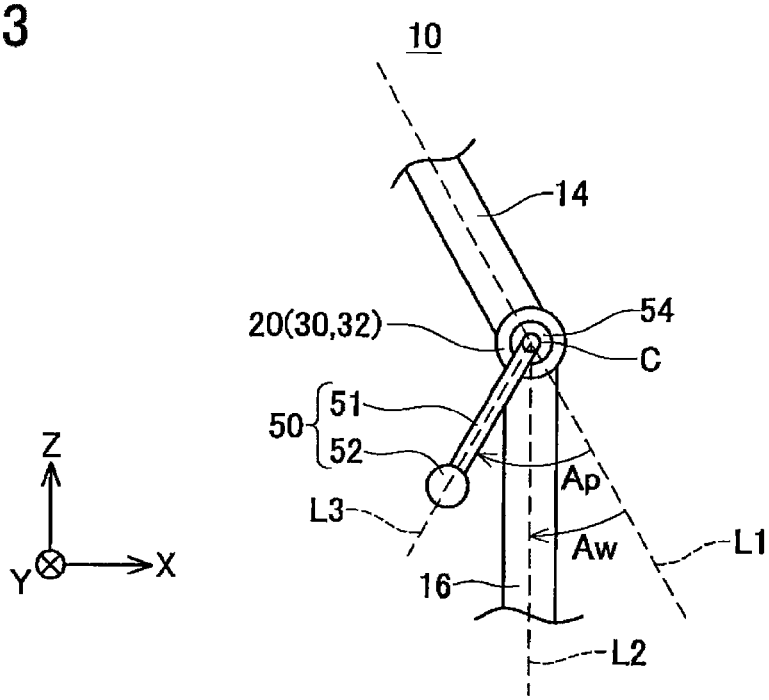
FIG. 3 shows an explanation of a pendulum attached to a rotary joint.
Figure 4:
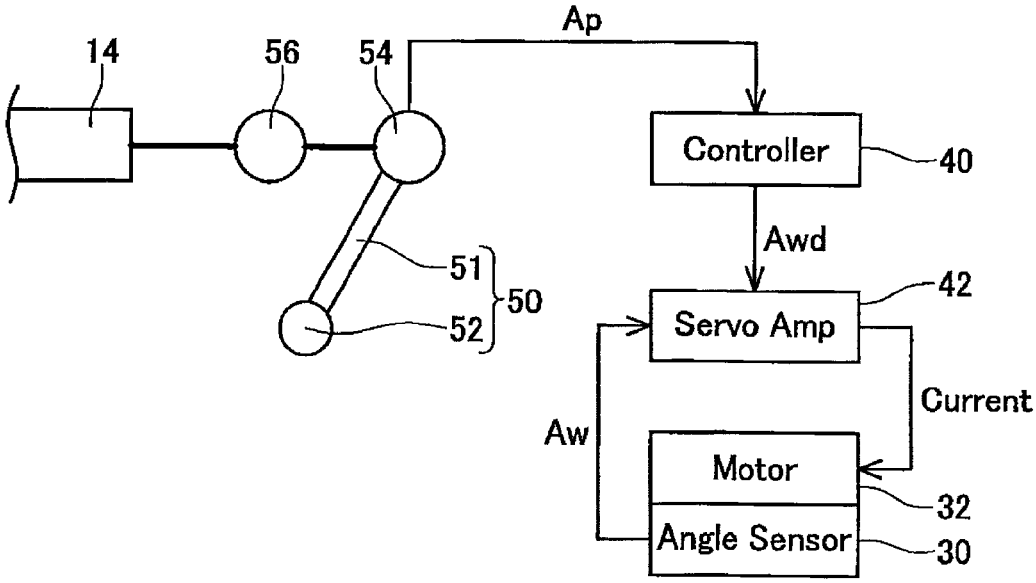
FIG. 4 shows a block diagram of the walking assist device.

The pendulum 50 is provided at the rotation axis of the first rotary joint 20. FIG. 3 shows the enlarged view of the pendulum 50. FIG. 4 shows a structure of the pendulum 50 and a control block diagram. The pendulum 50 is built of a rod 51 and a weight (a bob) 52. The upper end of the rod 51 is rotatably connected to the rotation axis C of the first rotary joint 20 (the shaft of the first rotary joint 20). The rod 51 may e.g. be a few centimeters. The weight 52 is attached to the lower end (tip) of the rod 51. A rotation angle sensor 54 is provided between the rod 51 and the rotation axis C. The rotation angle sensor 54 measures the swing angle of the pendulum (the swing angle Ap). The rotation angle sensor 54 corresponds to one example of the pendulum sensor. The swing of the pendulum 50 emulates a natural movement of the user's lower leg during the swing phase. As shown in FIG. 3, the swing angle Ap is defined as an angle between the centerline L1 of the upper link 14 and the centerline L3 of the pendulum 50 (of the rod 51). It is noted that the symbol Aw in FIG. 3 denotes the swing angle of the lower link 16 (i.e. the rotation angle of the first rotary joint). The swing angle Aw of the lower link 16 is defined as an angle between the centerline L1 of the upper link 14 and the centerline L2 of the lower link 16.

A damper 56 may be provided between the rod 51 and the upper link 14. The damper 56 is provided in order to suppress the excessive swing of the pendulum 50. It is noted that the damper is abbreviated in FIG. 3.

The control system of the walking assist device 10 will be explained with reference to FIG. 4. The controller 40 receives the swing angle Ap of the pendulum 50 from the rotation angle sensor 54. The controller 40 determines a target swing angle Awd of the lower link 16 based on the swing angle Ap and outputs the determined target swing angle Awd to the servo amplifier 42. The servo amplifier 42 is a part of the controller that controls the motor 32. It is noted that the target swing angle Awd corresponds to the target angle for the first rotary joint 20. Typically, the target swing angle Awd of the lower link 16 may be equal to the swing angle Ap of the pendulum 50. The servo amplifier 42 obtains the swing angle Aw of the lower link 16 from the angle sensor 30. The swing angle Aw measured by the angle sensor 30 may be referred to as "the measured swing angle Aw" hereinafter. The servo amplifier 42 outputs electric current commands to the motor 32 so that the difference between the measured swing angle Aw and the target swing angle Awd becomes zero. That is, the controller 40 (including the servo amplifier 42) controls the motor 32 so that the swing angle Aw of the lower link 16 follows the swing angle Ap of the pendulum 50.

Figure 5A:
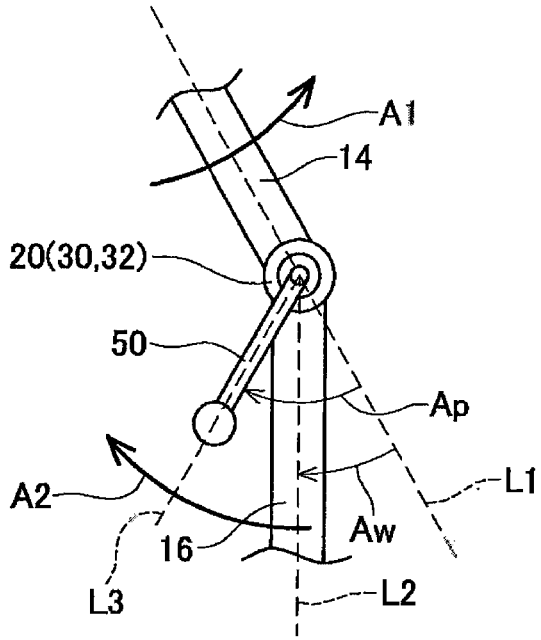
FIG. 5A shows a swing motion of the pendulum in the swing phase (1).

The pendulum 50 can freely swing. Therefore, the pendulum 50 swings in response to the motion of the upper leg. Here, the movement of the pendulum 50 in response to the swing of the upper link 14 (i.e. the swing of the user's upper leg) will be explained with reference to FIG. 5A and FIG. 5B. During the standard walking motion, the upper leg starts swinging forward just after the leg takes off. The upper leg swings forward with the pitch axis of the hip joint to be a center. The arrow A1 in FIG. 5A represents the swing direction of the upper leg (the upper link 14) at this moment. When the upper link 14 starts swinging forward, the pendulum 50 starts swinging backward in relative by inertia force. The arrow A2 in FIG. 5A represents the swing direction of the pendulum 50 at this moment. For the natural smooth walking motion, the user's lower leg preferably swings similar to the pendulum 50. The walking assist device 10 controls the motor 32 so that the swing angle Aw of the lower link 16 follows the swing angle Ap of the pendulum 50. According to such control scheme, the walking assist device 10 leads the user's lower leg to achieve a natural smooth walking motion by naturally swinging the user's lower leg in synchrony with the swing of the user's upper leg.

Figure 5B:
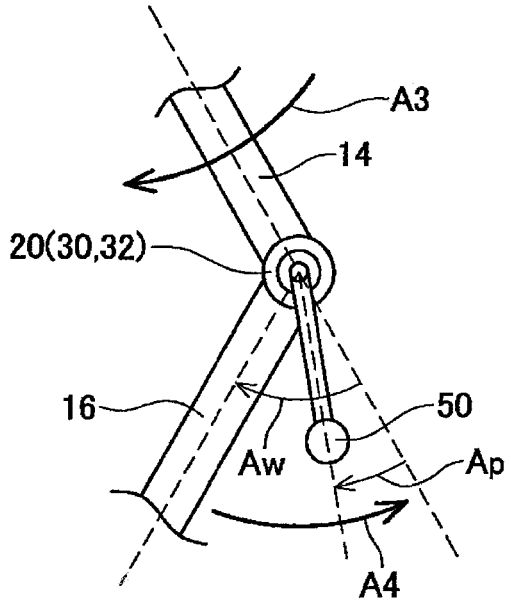
FIG. 5B shows a swing motion of the pendulum in the swing phase (2).

Furthermore, during the standard walking motion, the upper leg starts swinging backward after the swing leg grounds. The upper leg swings backward with the pitch axis of the hip joint to be a center. The arrow A3 in FIG. 5B represents the swing direction of the upper leg (the upper link 14) at this moment. When the upper link 14 swings back, the pendulum 50 swings forward in relative by inertia force. The arrow A4 in FIG. 5B represents the swing direction of the pendulum 50 at this moment. Same as the previous discussion, the user's lower leg also preferably swings similar to the pendulum 50 for achieving the natural smooth walking motion. The walking assist device 10 controls the motor 32 so that the swing angle Aw of the lower link 16 follows the swing angle Ap of the pendulum 50. According to such control strategy, the walking assist device 10 guides the user's lower leg to achieve the natural smooth walking motion.

The effect of the pendulum 50 will be explained. The pendulum 50 is disposed coaxially with the knee joint, and swings in response to the swing motion of the upper link. The pendulum 50 makes up a double pendulum together with the upper link 14. In general, it is known that the swing motion of the upper and lower legs in the walking motion is similar to the swing motion of the double pendulum. Thus, the swing motion of the pendulum 50 may be employed as a reference model for the ideal lower leg swing motion. The walking assist device 10 assists the user's leg motion to achieve the ideal walking motion by controlling the lower link 16 so as to follow the swing motion of the pendulum 50. Furthermore, it may be achieved at low cost because the above described structure of the pendulum 50 is quite simple. By employing the pendulum that can be implemented with low cost, compared to a case of having an expensive inclination sensor. Thus, the walking assist device may be provided at a low cost.

Figure 6:
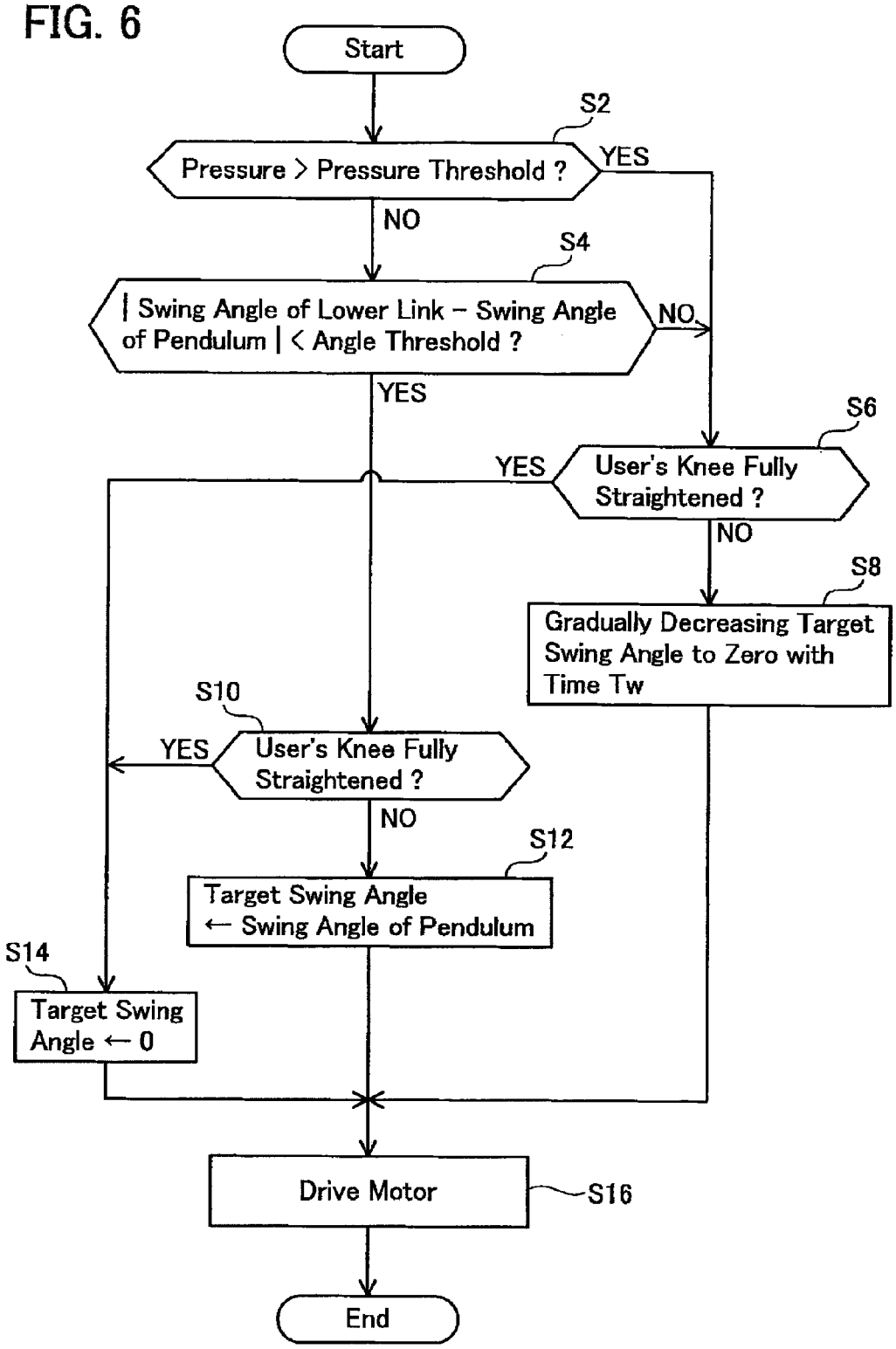
FIG. 6 shows a control flowchart.

The control flowchart of the controller 40 will be explained with reference to FIG. 6. The processes of the flowchart of FIG. 6 are repeatedly performed at every servo control cycle (e.g. at every 2 milliseconds). First, the controller 40 obtains the sensor data of the pressure sensor 19, and compares the pressure applied to the sole of the foot link 18 with a threshold (S2). When the pressure is higher than the threshold, the controller 40 determines that the leg wearing the walking assist device 10 grounds (S2: YES). That is, the controller 40 determines that the leg wearing the walking assist device 10 is in the stance phase. On the other hand, when the pressure is lower than the threshold, the controller 40 determines that the leg wearing the walking assist device 10 is in the swing phase (S2: NO).

When the leg is in the stance phase (S2: YES), the controller 40 determines whether the user's knee is fully straightened or not. Here, the phrase "the knee is fully straightened" means that the upper link 14 and the lower link 16 align straight. In accordance with the definition in FIG. 3, "the knee is fully straightened" corresponds to the situation in which the swing angle of the lower link 16 is equal to zero. If the knee is not fully straightened (S6: NO), the controller 40 gradually decreases the target swing angle Awd of the lower link 16 so that the target swing angle Awd becomes zero after the time span Tw has elapsed. In other words, the controller 40 gradually decreases the target swing angle Awd so that the knee is fully straightened after the time span Tw has elapsed (S8). After that, the controller 40 drives the motor 32 so that the measured swing angle Aw of the lower link 16 becomes the target swing angle Awd.

When the controller 40 determines that the knee is fully straightened (S6: YES), the controller 40 sets the target swing angle Awd to zero (S14), and drives the motor 32 so that the measured swing angle Aw of the lower link 16 becomes the target swing angle Awd (S16). The processes of steps S14 and S16 intend to hold the knee fully straightened.

On the other hand, when the leg is in the swing phase (S2: NO), the controller 40 compares the difference between the measured swing angle Aw of the lower leg 16 and the swing angle Ap of the pendulum 50 with an angle threshold. The angle threshold is stored in the controller 40 in advance. When the difference is greater than the angle threshold (S4: NO), the controller 40 judges that some sort of abnormality is occurring, and drives the motor 32 so that the knee becomes fully straightened through performing steps S6 and S8.

When the difference is smaller than the angle threshold (S4: YES), the controller 40 determines whether or not the knee is fully straightened (S10). When the knee is not fully straightened (S10: NO), the controller 40 sets the target swing angle Awd of the lower link 16 with the swing angle Ap of the pendulum 50. Then, the controller 40 drives the motor 32 so that the measured swing angle Aw of the lower link 16 follows the target swing angle Awd (S16). The processes of steps S12 and S16 correspond to the process of controlling the swing of the lower link so as to follow the swing angle of the pendulum.

When the controller 40 judges that the knee is fully straightened (S10: YES), the controller 40 sets the target swing angle Awd to zero (S14) and drives the motor 32 so that the measured swing angle Aw goes to the target swing angle Awd (S16). That is, the controller 40 controls the 32 so as to hold the knee to be fully straightened.

The advantages of the above described processes will be explained. The controller 40 assists the motion of the leg so that the knee goes to be fully straightened when the leg that wears the walking assist device 10 is in the stance phase. The stance leg has to hold the user's whole weight. The walking assist device 10 assists in holding the user's weight by straightening the knee of the stance leg. Furthermore, the controller 40 also controls the lower link 16 so that the knee goes to be fully straightened when the difference between the measured swing angle Aw of the lower link 16 and the swing angle Ap of the pendulum is greater than the threshold (S4: NO). When the difference is greater than the threshold, it may be determined that some sort of abnormality has probably been happened. Under such a situation, the walking assist device 10 guides the user's lower leg so as to straighten the knee.

Figure 7:
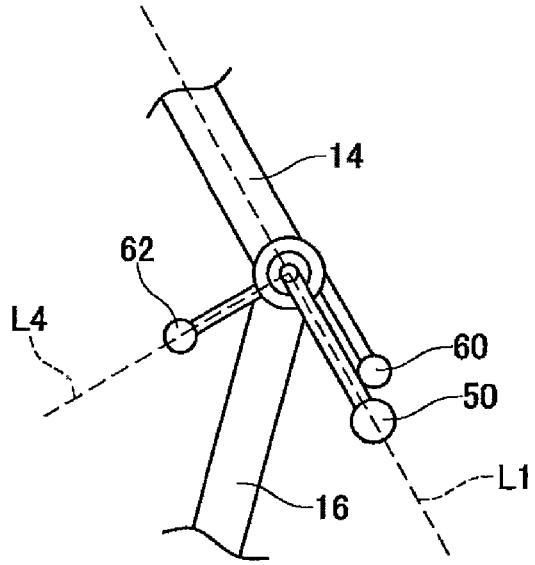
FIG. 7 shows an explanation of a stopper that limits a swing angle of the pendulum.

Some preferred modifications of the walking assist device 10 will be explained. The walking assist device 10 preferably has a stopper that limits a relative angle between the lower link 16 and the pendulum 50 within a predetermined threshold. FIG. 7 shows an example of the stopper. The walking assist device shown in FIG. 7 has a first stopper 60 and a second stopper 62 that are fixed to the upper link 14. The first stopper 60 extends along the center link L1 of the upper link 14. The first stopper 60 restricts the swing range of the pendulum 50 so that the swing angle Ap of the pendulum 50 does not go below zero, i.e. so that the pendulum 50 does not swing forward beyond the centerline L1 of the upper leg. The lower leg of the human can not swing forward beyond the centerline L1 of the upper leg. The first stopper 60 restricts the forward swing boundary of the pendulum 50 to be within the physical range of the human knee joint FIG. 7 depicts a situation in which the pendulum 50 is in contact with the first stopper 60.

The second stopper 62 extends along the straight line L4 that crosses to the centerline L1 of the upper link at a right angle. The second stopper 62 restricts the swing range of the pendulum 50 so that the swing angle of the pendulum 50 does not go beyond 90 degrees. The second stopper 62 restricts the swing range of the lower link 16 within a proper range being expected during the standard walking motion.

A spring may preferably be provided between the pendulum 50 and the upper link 14. The spring generates the restoring force that puts the pendulum 50 back to the neutral position in response to the swing angle of the pendulum 50. The dynamic characteristics of the pendulum 50 may be determined by properly selecting the spring constant K, the damping coefficient D of the aforementioned damper 56, the length of the rod 51, and the mass of the weight 52. It is preferable to select those parameters (the spring constant K, the damping coefficient D of the damper 56, the length of the rod 51, and the mass of the weight 52) so that the dynamics of the pendulum 50 corresponds to the dynamics of the user's lower leg.

The above embodiment includes examples of a stopper that limits a relative angle between the lower link 16 and the pendulum 50 (i.e. the difference in Aw and Ap) to be below a predetermined threshold. Furthermore, in the above embodiment, the controller may preferably stop the control for the actuator when the relative angle between the lower link 16 and the pendulum 50 exceeds the predetermined threshold.

Combinations of features and steps disclosed in the presently detailed description may not be necessary to practice the invention in the broadest sense, and are instead taught merely to particularly describe representative examples of the invention. Furthermore, various features of the presently described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

The invention claimed is:

1. A walking assist device comprising:

an upper link to be attached to an upper leg of a user;

a lower link to be attached to a lower leg of the user;

a rotary joint that swingably connects the lower link to the upper link;

an actuator that swings the lower link;

a pendulum provided at a rotation axis of the rotary joint; the pendulum swings in response to a swing of the upper leg of the user;

a sensor that measures a swing angle of the pendulum; and a controller that controls the actuator so that the swing of the lower link follows a swing motion of the pendulum based on the swing angle of the pendulum.

2. The walking assist device of claim 1, wherein a stopper that limits a relative angle between the lower link and the pendulum below a predetermined threshold is provided to the upper link.

* * * * *